US006536242B1

(12) United States Patent
Boutiette

(10) Patent No.: US 6,536,242 B1
(45) Date of Patent: Mar. 25, 2003

(54) PRESSURE RELIEF DRAIN PUMP ASSEMBLY FOR APPLIANCE

(75) Inventor: Todd Paul Boutiette, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,163

(22) Filed: Nov. 27, 2001

(51) Int. Cl.[7] ..... D06F 39/02
(52) U.S. Cl. ..... 68/3 R; 68/208
(58) Field of Search ..... 68/184, 208, 3 R; 415/110, 111, 229

(56) References Cited

U.S. PATENT DOCUMENTS 2,070,357 A * 2/1937 Hallinan
2,108,621 A * 2/1938 Straitz
2,207,621 A * 7/1940 Doeg
2,237,018 A * 4/1941 Tweedale
2,487,328 A * 11/1949 George et al.
2,742,128 A * 4/1956 Woodson
3,023,590 A * 3/1962 Playale
3,118,384 A * 1/1964 Sence et al.
3,639,791 A * 2/1972 Jenkin
3,752,601 A * 8/1973 Karagozian
4,168,615 A 9/1979 Condit
4,834,623 A * 5/1989 Triolo et al.
5,263,818 A * 11/1993 Ito et al.
5,577,399 A 11/1996 Whipple, III et al.
5,868,011 A 2/1999 Hawkins et al.
6,012,849 A * 1/2000 Takagi
6,264,441 B1 7/2001 Marioni

FOREIGN PATENT DOCUMENTS

JP 3-32936 * 2/1992

* cited by examiner

*Primary Examiner*—Frankie L. Stinson
(74) *Attorney, Agent, or Firm*—Armstrong Teasdale LLP

(57) ABSTRACT

A motor for a drain pump assembly is provided. The motor includes a motor housing having a rotor chamber and a rotor assembly received in said rotor chamber. The rotor assembly includes a rotor shaft received in said rotor chamber and supported therein on a bearing assembly. An end shield includes a cavity for receiving an end of said rotor shaft and a pressure relief bore extending from said cavity to said rotor chamber.

20 Claims, 3 Drawing Sheets

PRESSURE RELIEF DRAIN PUMP ASSEMBLY FOR APPLIANCE

BACKGROUND OF INVENTION

This invention relates generally to pump assemblies, and, more particularly, to drain pump assemblies for appliances.

Certain appliances, such as clothes washing machines and dishwashers, for example, include drain pumps for removing wash fluid from wash tubs in the appliances. The drain pump assembly is typically located below the tub so that water drains into the pump from the tub with gravity assisted action, and the pump assembly is activated to pump the fluid from a pump inlet to a pump outlet in communication with a discharge outlet of a building plumbing system. See, for example, U.S. Pat. Nos. 5,868,011 and 4,168,615.

More specifically, such a drain pump assembly typically includes an electric motor operatively coupled to a controller to activate and deactivate the pump assembly as desired. In operation, however, inlet pressure of the pump assemblies oscillates as suction is lost due to mixing of air and water in the tub, and due to sporadic flow of the wash fluid through a suction pipe. See, for example, U.S. Pat. No. 5,577,399.

Oscillations in pump inlet pressure, in turn, cause oscillations in the rotor assembly of the pump motor and results in pressure buildup within the pump motor. This oscillation of the rotor assembly and associated pressure effects have been found to dislodge motor bearings and adversely impact pump performance and operation, to create unpleasant noises in operation of the appliance, and to negatively impact appliance reliability and customer satisfaction.

SUMMARY OF INVENTION

In one aspect, a motor for a drain pump assembly is provided. The motor comprises a motor housing comprising a rotor chamber and a rotor assembly received in said rotor chamber. The rotor assembly comprises a rotor shaft received in said rotor chamber and supported therein on a bearing assembly. An end shield comprises a cavity for receiving an end of said rotor shaft and a pressure relief bore extending from said cavity to said rotor chamber.

In another aspect, a drain pump assembly for an appliance is provided. The drain pump assembly comprises a pump housing and a motor housing coupled to said pump housing, said motor housing comprising a rotor chamber therein. A rotor assembly is situated within said rotor chamber and comprises a rotor shaft, a bearing assembly, and a bushing surrounding said rotor shaft. An end shield extends over said rotor assembly, said end shield comprising a bearing cavity receiving said bushing, and a pressure relief bore in fluid communication with said rotor chamber and in fluid communication with said bearing cavity.

In a further aspect, an appliance comprises a cabinet, a tub within said cabinet, and a drain pump assembly for draining fluid from said tub. The pump assembly comprises a motor housing comprising a rotor chamber, and a rotor assembly coupled to said motor housing and comprising a rotor shaft, a bearing assembly, and a bushing surrounding said rotor shaft. An end shield comprises a bearing cavity receiving said bushing, and a pressure relief bore in fluid communication with said rotor chamber and in fluid communication with said bearing cavity.

In still another aspect, a drain pump assembly comprises a pump housing comprising an inlet, an outlet, and a pump chamber. A motor housing is coupled to said pump housing and comprises a rotably mounted rotor assembly within a rotor chamber. The rotor assembly comprises a rotor shaft comprising a first end, a second end, and a bearing assembly. An impeller is mounted to said rotor first end and situated within said pump chamber, and an end shield comprises a bearing cavity inserted over said second end of said shaft and a pressure relief bore for relieving pressure in said bearing cavity as said rotor assembly oscillates in operation.

DETAILED DESCRIPTION

Figure 1:
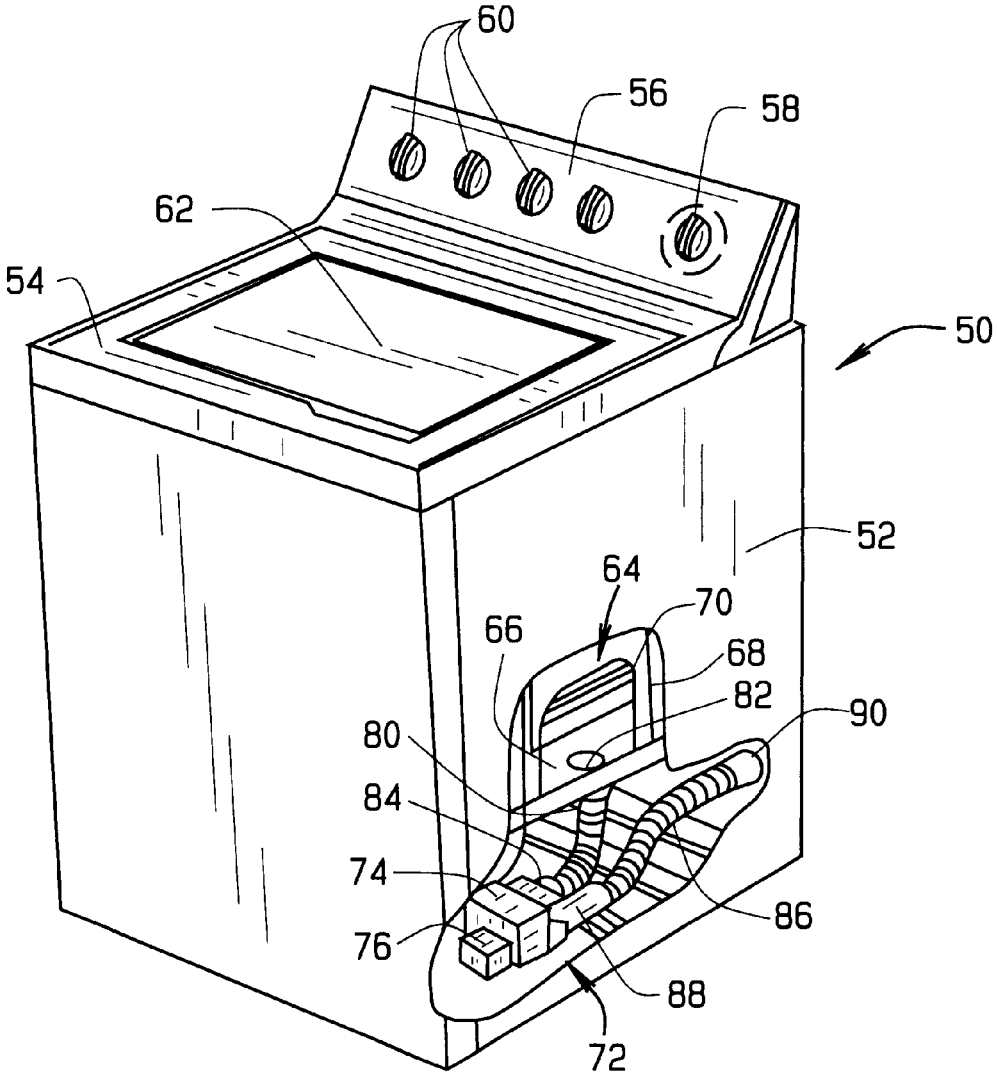
FIG. 1 is a perspective cutaway view of an exemplary appliance.

FIG. 1 is a perspective view of an exemplary appliance 50 partially broken away. While the illustrated appliance 50 is a clothes washing machine, appliance 50 is but one type of appliance in which the benefits of the present invention are realized. It is contemplated that the present invention may be practiced in other appliances beyond that specifically illustrated and described herein, and in particular it is recognized that the present invention is well suited for applications in other types of appliances, such as dishwashers, as well as to drain pump assemblies generally for a wide variety of applications. Therefore, appliance 50 is offered by way of illustration rather than limitation, and it is appreciated that the invention may be practiced in a wide variety of appliances and applications without departing from the scope and spirit of the instant invention.

Exemplary appliance 50 includes a cabinet 52 and a cover 54. A backsplash 56 extends from cover 54, and a timer mechanism 58 and variety of appliance control input selectors 60 are coupled to backsplash 56. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74, a motor 76, and in an exemplary embodiment a motor fan (not shown). A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

In an illustrative embodiment, clothes are loaded into basket 70, and washing operation is initiated through operator manipulation of control input selectors 60 and timer mechanism 58. Tub 64 is filled with water and mixed with detergent to form a wash fluid, and basket 70 is agitated with an agitator (not shown) for cleansing of clothes in basket 70. After a predetermined period of agitation, tub 64 is drained with pump assembly 72, refilled with clean water to rinse clothes in basket 70, and agitated again to remove detergent from clothes. Occasionally, basket 70 may be spun in addition to, or in lieu of agitation, for additional washing action and to repel water and wash fluid from clothes.

For a variety of reasons, inlet pressure of pump assembly 72 oscillates during use of appliance 50. For example, varying degrees of suds and foam are created when a detergent is mixed with water in tub 64 to form a wash fluid, and the suds and foam sometimes cause irregular and uneven flow into drain pump assembly 72. Also, pump assembly 72 is activated, for example, for a time after tub 64 is drained, such as during spin cycles to drain wash fluid repelled from clothes, thereby generating a liquid/air mixture in pump assembly 72. Oscillation of pump inlet pressure causes oscillation in components of motor 76 that can lead to pressure buildups in motor 76. Unlike known pump assemblies, however, pump assembly 72 includes pressure relief features, described further below, that prevent pressure imbalances in motor 76 that can impair motor.performance, reliability and enjoyment.

Figure 2:
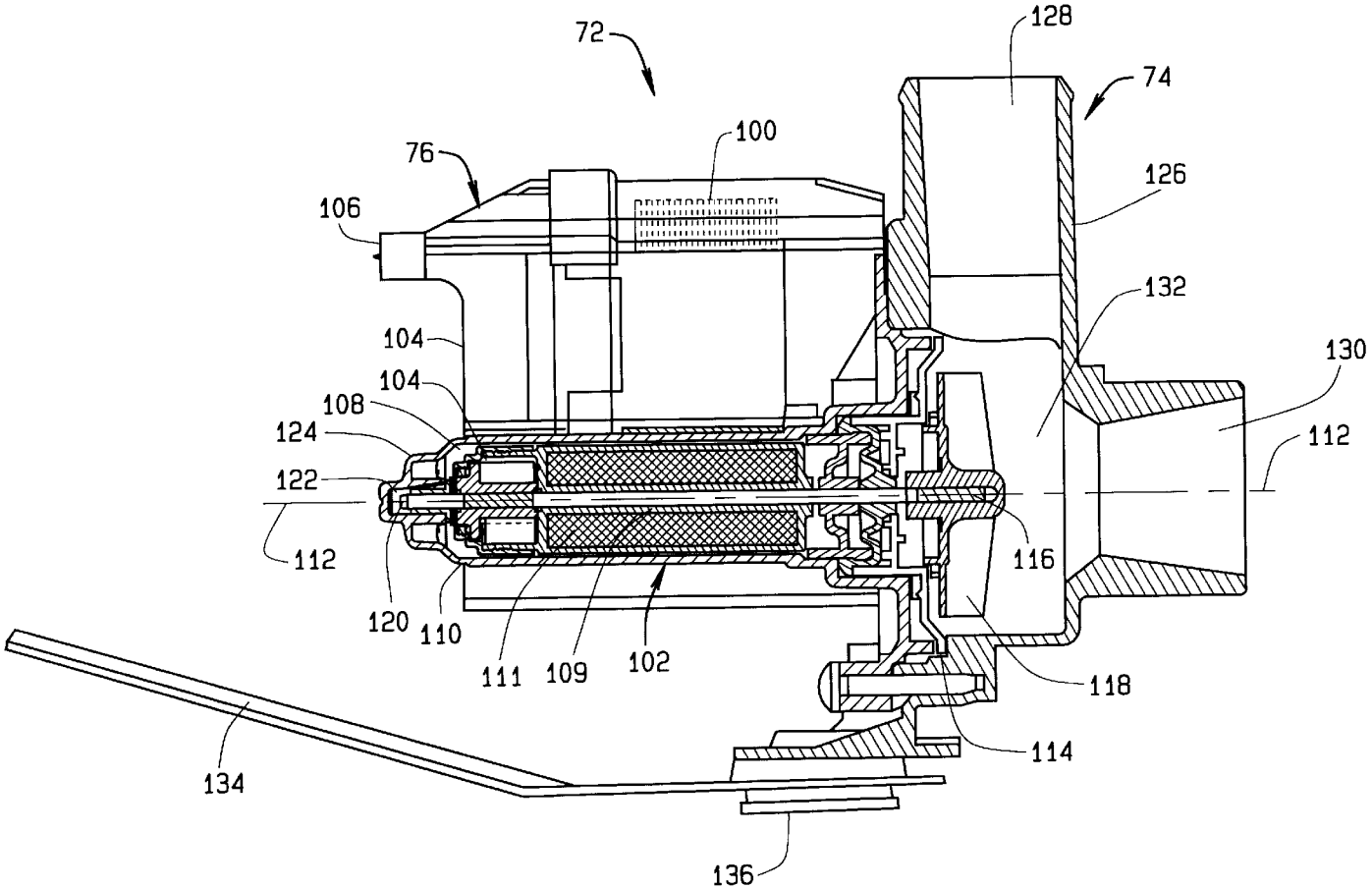
FIG. 2 is a partial cross sectional view of a drain pump assembly for the appliance shown in FIG. 1.

FIG. 2 is a partial cross sectional view of drain pump assembly 72 for use in, for example, appliance 50 (shown in FIG. 1) including motor 76 and pump 74. Motor 76 includes a stator assembly 100 and a rotor assembly 102 within a motor housing 104. Electrical power is supplied to motor 76 through a connector 106 for energizing stator assembly 100 and producing magnetic fields that induce rotary motion in rotor assembly 102. Signals are supplied to connector 106 from an appliance controller (not shown), such as a known microprocessor based controller for draining wash tub 64 (shown in FIG. 1) at appropriate times during operation of appliance 50 (shown in FIG. 1). It is believed that further aspects of the controller and the execution of control algorithms are well within the purview of those in the art but beyond the scope of the present invention, so further discussion thereof is omitted.

Rotor assembly 102 is situated in a rotor chamber 108 in the form of a longitudinally extending bore within motor housing 104. Rotor assembly 102 is received in rotor chamber 108 and includes a rotor shaft 109, a permanent magnet 111, and a starting assembly 110 therein for imparting rotational movement of shaft 109 about a longitudinal axis 112 extending through rotor chamber 108. A seal plug 114 is coupled to and extends across rotor chamber 108 at one end thereof, and a first end 116 of rotor shaft 109 extends through seal plug 114 and includes a pump impeller 118 coupled thereto.

A second end 120 of rotor shaft 109 extends into a rear cavity 122 of a motor end shield 124. In one embodiment, end shield 124 is integral to motor housing 104. In an alternative embodiment, end shield 124 is separately fabricated and coupled to motor housing 104.

As explained in some detail further below, end shield 124 is configured to relieve pressure buildup that can be encountered in end shield rear cavity 122 as rotor shaft 109 oscillates when pump assembly 72 is activated.

Pump 74 includes a pump housing 126 forming a pump outlet 128, a pump inlet 130 and a pump chamber 132 therebetween wherein impeller 118 is located. When motor 76 is activated, impeller 118 rotates about longitudinal axis 112 with rotor shaft 109, thereby creating a negative pressure that draws fluid into pump inlet 130 from wash tub 64 (shown in FIG. 1) through inlet hose 80 (shown in FIG. 1). Impeller 118 forces fluid from pump chamber 132 into pump outlet 128, thereby creating positive pressure at pump outlet 128. A mounting bracket 134 and retainer clip 136 extend from pump housing 126 for mounting pump assembly 72 to an appliance frame (not shown).

In use, pressure at pump inlet 130 varies due to conditions in pump chamber 132, including but not limited to suds and foam in wash fluid that affect the composition and density of fluid in pump chamber 132, liquid/air mixtures in pump chamber 130 and the presence of foreign objects in pump inlet 130, pump chamber 132, and/or pump outlet 128. Varying conditions in pump chamber 132 and fluctuating inlet pressures have a tendency to cause impeller 118, and attached rotor assembly 102 to oscillate with a side-to-side motion (left to right and vice versa in FIG. 2) that in certain motors, such as motor 76, has been observed to create sufficient pressure in end shield cavity 122 so as to dislodge the motor bearing assembly and create a number of undesirable issues in pump assembly operation. These issues, however, are avoided with end shield 124, as further explained below, that is configured to eliminate pressure buildup at rotor shaft end 120.

Figure 3:
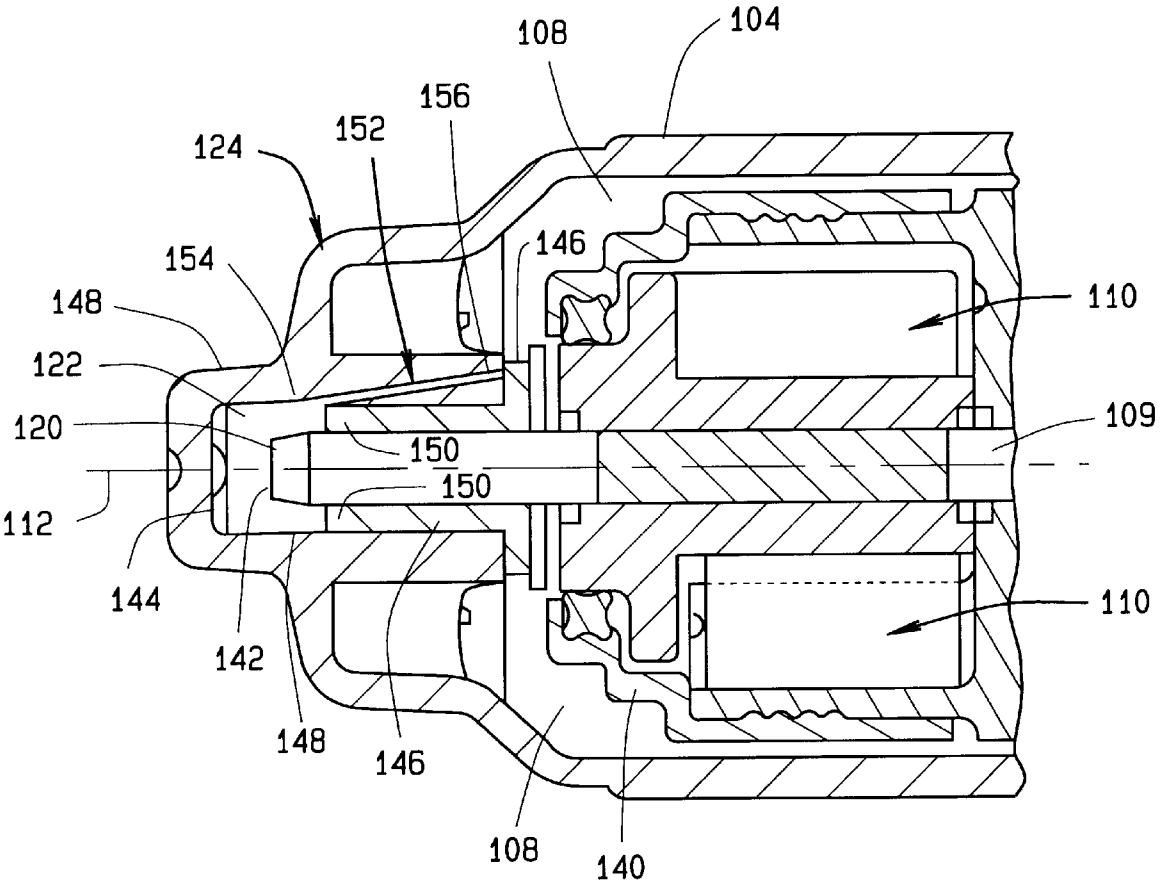
FIG. 3 is a magnified view of a portion of the drain pump assembly shown in FIG. 2.

FIG. 3 is a magnified view of a portion of drain pump assembly 72, and more specifically, end shield 124 that receives rotor shaft end 120. A bearing assembly including a bushing 146 supports rotor shaft 109 adjacent shaft end 120 within rotor chamber 108. Motor starting assembly 110 is supported, in turn by a rotor cap 140 surrounding starting assembly 110 and received in rotor chamber 108 within motor housing 104. End shield 124 extends over shaft end 120 such that shaft end 120 is received in a cavity 122 such that a leading edge 142 of shaft end 120 is separated from a rear wall 144 of cavity 122 that defines an end of cavity 122.

Bushing 146 surrounds rotor shaft 109 adjacent shaft end 120 and is in a near sealing engagement with longitudinal side walls 148 of end shield cavity 122 that receives rotor shaft 109. Bushing 146 extends partly into end shield cavity 122 for a distance less than rotor shaft end 120, and a clearance is created in cavity 122 between a rearward end 150 of bushing 146, end shield cavity side walls 148, end shield cavity end wall 144, and an outer surface of rotor shaft 109, or more specifically rotor shaft end 120.

To prevent problematic pressure buildup in end shield cavity 122, a pressure relief bore 152 is formed into end shield 124 to place end shield cavity 122 in fluid communication with rotor chamber 108. More specifically, relief bore 152 includes an inlet 154 spaced from bushing 146, or more specifically spaced from bushing end 150, and an outlet 156 in fluid communication with rotor chamber 108. As such, relief bore inlet 154 is in fluid communication with the clearance in end shield cavity 122 for unobstructed fluid flow through pressure relief bore 152 when pressure builds up in rear cavity 122 as rotor shaft 109 oscillates in operation.

In the illustrated embodiment, relief bore 152 extends at an angle relative to rotor assembly longitudinal axis 112 to place end shield rear cavity 122 and rotor chamber 108 in flow communication with one another. It is recognized, however, that in alternative embodiments, relief bore 152 could extend parallel to or perpendicular to longitudinal axis 112 in one or more segments to relieve pressure generated in end shield rear cavity 122.

In addition, in an exemplary embodiment, relief bore 152 is substantially circular in cross section, thereby forming a substantially cylindrical passage from relief bore inlet 154 to relief bore outlet 156. It is contemplated, however, that rectangular, elliptical, and other known polygonal or curved cross sectional passages may be likewise employed in lieu of a circular or cylindrical passage without departing from the scope of the instant invention.

By placing end shield rear cavity 122 in flow communication with rotor chamber 108 via pressure relief bore 152, excessive pressure in end shield cavity 122 is avoided, together with associated negative effects on the bearing assembly bushing 146. Motor performance is thereby preserved and a more reliable, smooth running pump assembly is provided that will benefit consumers and manufacturers alike.

While the invention has been described in terms of various specific embodiments, those skilled in the art will recognize that the invention can be practiced with modification within the spirit and scope of the claims.

What is claimed is:

1. A motor for a drain pump assembly, said motor comprising:

a motor housing comprising a rotor chamber;

a rotor assembly received in said rotor chamber, said rotor assembly comprising a rotor shaft received in said rotor chamber and supported therein on a bearing assembly, and an end shield comprising a cavity for receiving an end of said rotor shaft and a pressure relief bore extending from said cavity to said rotor chamber.

2. A motor in accordance with claim 1 further comprising a bushing surrounding said shaft within said rotor chamber adjacent said bearing assembly, said pressure relief bore comprising an inlet, said inlet spaced from said bushing.

3. A motor in accordance with claim 2 wherein said bushing is in sealing engagement with said shaft and said rotor chamber.

4. A motor in accordance with claim 1 wherein said shaft is situated in said cavity so as to provide a clearance between an end of said shaft and an end of said cavity, said relief bore in fluid communication with said clearance.

5. A motor in accordance with claim 1 wherein said relief bore is substantially cylindrical.

6. A motor in accordance with claim 1 wherein said relief bore extends at an angle to said longitudinal bore.

7. A drain pump assembly for an appliance, said drain pump assembly comprising:

a pump housing;

a motor housing coupled to said pump housing, said motor housing comprising a rotor chamber therein;

a rotor assembly situated within said rotor chamber, said rotor assembly comprising a rotor shaft, a bearing assembly, and a bushing surrounding said rotor shaft; and an end shield extending over said rotor assembly, said end shield comprising a bearing cavity receiving said bushing, and a pressure relief bore in fluid communication with said rotor chamber and in fluid communication with said bearing cavity.

8. A drain pump assembly in accordance with claim 7 wherein said relief bore is substantially cylindrical.

9. A drain pump assembly in accordance with claim 7 wherein said relief bore is substantially rectangular.

10. A drain pump assembly in accordance with claim 7 wherein said relief bore extends at an angle to said longitudinal bore.

11. A drain pump assembly in accordance with claim 7, said pressure relief bore comprising an inlet, said inlet spaced from said bushing.

12. A drain pump assembly in accordance with claim 11 wherein said bushing is in sealing engagement with said shaft and said longitudinal bore.

13. A drain pump assembly in accordance with claim 12 wherein said shaft is situated in said bearing cavity so as to provide a clearance between an end of said shaft and an end of said cavity, said pressure relief bore in fluid communication with said clearance.

14. An appliance comprising:

a cabinet;

a tub within said cabinet; and a drain pump assembly for draining fluid from said tub, said pump assembly comprising:

a motor housing comprising a rotor chamber;

a rotor assembly coupled to said motor housing, said rotor assembly comprising a rotor shaft, a bearing assembly, and a bushing surrounding said rotor shaft;

an end shield comprising a bearing cavity receiving said bushing, and a pressure relief bore in fluid communication with said rotor chamber and in fluid communication with said bearing cavity.

15. An appliance in accordance with claim 14, said pressure relief bore comprising an inlet spaced from said bushing.

16. An appliance in accordance with claim 15 wherein said relief bore is substantially cylindrical.

17. An appliance in accordance with claim 16 wherein said relief bore extends at an angle to said longitudinal bore.

18. An appliance in accordance with claim 15 wherein said appliance comprises a washing machine.

19. A drain pump assembly comprising;

a pump housing comprising an inlet, an outlet, and a pump chamber;

a motor housing coupled to said pump housing and comprising a rotably mounted rotor assembly within a rotor chamber, said rotor assembly comprising a rotor shaft comprising a first end, a second end, and a bearing assembly;

an impeller mounted to said rotor first end and situated within said pump chamber; and an end shield comprising a bearing cavity inserted over said second end of said shaft and a pressure relief bore for relieving pressure in said bearing cavity as said rotor assembly oscillates in operation.

20. A drain pump assembly in accordance with claim 19 wherein said bearing assembly comprises a bushing surrounding said rotor shaft, said bushing received in said bearing cavity, said pressure relief bore comprising an inlet spaced from said bushing and an outlet in fluid communication with said rotor chamber.

* * * * *